US009644494B2

(12) United States Patent
Hashimoto

(10) Patent No.: US 9,644,494 B2
(45) Date of Patent: May 9, 2017

(54) GAS TURBINE

(75) Inventor: Shinya Hashimoto, Tokyo (JP)

(73) Assignee: MITSUBISHI HITACHI POWER SYSTEMS, LTD., Yokohama-shi, Kanagawa (JP)

( * ) Notice: Subject to any disclaimer, the term of this patent is extended or adjusted under 35 U.S.C. 154(b) by 970 days.

(21) Appl. No.: 13/475,322

(22) Filed: May 18, 2012

(65) Prior Publication Data

US 2013/0064647 A1 Mar. 14, 2013

(30) Foreign Application Priority Data

Sep. 9, 2011 (JP) ..... 2011-197076

(51) Int. Cl.

| | |
|---|---|
| ***F01D 9/06*** | (2006.01) |
| ***F01D 25/16*** | (2006.01) |
| ***F01D 25/12*** | (2006.01) |
| ***F01D 25/30*** | (2006.01) |
| ***F01D 25/14*** | (2006.01) |

(52) U.S. Cl.

CPC ..... *F01D 25/12* (2013.01); *F01D 9/065* (2013.01); *F01D 25/14* (2013.01); *F01D 25/162* (2013.01); *F01D 25/30* (2013.01); *F05D 2230/54* (2013.01); *F05D 2250/314* (2013.01); *F05D 2260/607* (2013.01)

(58) Field of Classification Search

USPC ..... 415/110, 142

See application file for complete search history.

(56) References Cited

U.S. PATENT DOCUMENTS

| | | | | |
|---|---|---|---|---|
| 2,603,945 | A * | 7/1952 | Brown | 60/761 |
| 2,789,416 | A * | 4/1957 | Mirza | 60/266 |
| 4,079,587 | A | 3/1978 | Nordstrom et al. | |
| 5,020,318 | A * | 6/1991 | Vdoviak | 60/226.1 |
| 5,272,869 | A * | 12/1993 | Dawson et al. | 60/796 |
| 5,746,574 | A | 5/1998 | Czachor et al. | |
| 6,266,954 | B1 * | 7/2001 | McCallum et al. | 60/806 |
| 7,055,305 | B2 * | 6/2006 | Baxter et al. | 60/39.5 |

(Continued)

FOREIGN PATENT DOCUMENTS

| | | |
|---|---|---|
| CN | 101743391 A | 6/2010 |
| EP | 2187019 A1 | 5/2010 |

(Continued)

OTHER PUBLICATIONS

Europe Patent Office, "Search Report for EP 12788413.8," Jul. 29, 2014.

(Continued)

*Primary Examiner* — Sean J Younger

(74) *Attorney, Agent, or Firm* — Manabu Kanesaka; Benjamin Hauptman; Kenneth Berner

(57) ABSTRACT

A gas turbine configured to prevent eccentricity of a rotor (14) due to heat is installed with a strut (23), an outer diffuser (24), an inner diffuser (25), a strut cover (26), and a partition wall (28), wherein the gas turbine includes an inflow hole (31) for cooling air (W), a first flow passage (R1) formed between a casing wall (21) and the outer diffuser (24), a second flow passage (R2) formed between the strut (23) and the strut cover (26), a third flow passage (R3) formed between the inner diffuser (25) and the partition wall (28), and an outflow hole (51) installed in the inner diffuser (25).

4 Claims, 6 Drawing Sheets

(56) References Cited

U.S. PATENT DOCUMENTS

| | | | | |
|---|---|---|---|---|
| 7,373,773 | B2 * | 5/2008 | Noda | 60/266 |
| 7,614,150 | B2 * | 11/2009 | Lundgren | 29/889.21 |
| 8,740,550 | B2 | 6/2014 | Tanioka | |
| 2005/0050898 | A1 | 3/2005 | Noda | |
| 2010/0322759 | A1 * | 12/2010 | Tanioka | 415/180 |

FOREIGN PATENT DOCUMENTS

| | | | |
|---|---|---|---|
| JP | 56-129725 | A | 10/1981 |
| JP | 2005-83199 | A | 3/2005 |
| JP | 2009-243311 | A | 10/2009 |

OTHER PUBLICATIONS

PCT, "International Search Report and Written Opinion for PCT/JP2012/063725", Aug. 21, 2012.
Europe Patent Office, "Search Report for EP 12788413.8," Jun. 29, 2015.
China Patent Office, "Office Action for Chinese Patent Application No. 201510533082.0," May 19, 2016.
Europe Patent Office, "Decision to Grant a Patent for European Patent Application No. 127884118," Jul. 28, 2016.

* cited by examiner

GAS TURBINE

TECHNICAL FIELD

The present invention relates to a gas turbine installed with a cooling structure installed in an exhaust chamber.

This application claims priority to and the benefit of Japanese Patent Application No. 2011-197076 filed on Sep. 9, 2011, the disclosure of which is incorporated by reference herein.

BACKGROUND ART

A gas turbine can generate a rotational power by driving a turbine with a high-temperature, high-pressure combustion gas which is produced by combustion of a fuel gas and compressed air supplied into a combustor. The combustion gas having driven the turbine is discharged to the atmosphere after conversion of dynamic pressure into a static pressure in a diffuser of an exhaust chamber.

In such a gas turbine, the temperature of the combustion gas supplied to the turbine is very high due to increased efficiency. Therefore, cooling is performed on almost all components of the turbine, and it is also necessary to reliably cool inside of the exhaust chamber.

The above-mentioned gas turbine having a cooling structure in the exhaust chamber is disclosed in, for example, Patent Document 1, in which the exhaust chamber of the gas turbine is installed with a casing wall and struts. The strut is arranged in plurality in a circumferential direction at predetermined intervals, and connected to a bearing case which is disposed inside the casing wall in a radial direction and houses a bearing supporting a rotor, and supports the bearing case on the casing wall. By supplying cooling air into the exhaust chamber through a cooling flow passage which is formed between the strut and the strut cover installed in an outer circumferential side of the strut, cooling of the components in the exhaust chamber, such as the diffuser, the strut, and the strut cover is performed.

PRIOR ART DOCUMENT

Patent Document

[Patent Document 1] Japanese Patent Laid-open Publication No. 2009-243311

SUMMARY OF THE INVENTION

Problems to be Solved by the Invention

In the exhaust chamber of the gas turbine according to the above-mentioned related art, almost all of the components are manufactured by sheet metal welding, and a manufacturing dimensional tolerance is large also in the struts disposed in the circumferential direction. As a result, a difference in cooling effect occurs due to a difference in flow rate of the cooling air supplied through the cooling flow passage, resulting in a difference in amounts of thermal expansion of the components in the exhaust chamber. Accordingly, in the strut in particular, there has been a risk of contact between a rotary body and a stationary body, and performance degradation of the gas turbine caused by eccentricity between the bearing case and the rotor due to a difference in the amount of thermal expansion of the respective struts in the circumferential direction.

The present invention has been made in view of the above-mentioned circumstances, an object of which is to provide a gas turbine capable of preventing eccentricity of a rotor.

Means for Carrying Out the Invention

In order to solve the problems, the present invention employs the following means.

A gas turbine according to the present invention includes: a casing wall having a cylindrical shape centered at an axis and forming an outer shape of an exhaust chamber; a bearing case disposed inside the casing wall in a radial direction and supporting a bearing of a rotor; a plurality of struts installed on an outer circumferential surface of the bearing case at predetermined intervals in a circumferential direction of the bearing case and connecting the casing wall to the bearing case; an outer diffuser installed along an inner circumferential surface of the casing wall; an inner diffuser installed along the outer circumferential surface of the bearing case; a strut cover connecting the outer diffuser to the inner diffuser and covering the strut from an outer circumference side of the strut; and a partition wall installed between the inner diffuser and the bearing case and covering the bearing case from an outer circumference side of the bearing case, wherein the gas turbine includes: an inflow hole installed in the casing wall and taking in cooling air from the outside; a first flow passage formed between the casing wall and the outer diffuser and communicated with the inflow hole to allow the cooling air to flow therethrough; a second flow passage formed between the strut and the strut cover and communicated with the first flow passage to allow the cooling air to flow therethrough; a third flow passage formed between the inner diffuser and the partition wall and communicated with the second flow passage to allow the cooling air to flow therethrough; and a flow rate adjustment device installed in at least one of the second flow passage and the third flow passage.

In the gas turbine, the cooling air is taken in from the inflow hole and flows through the first flow passage, the second flow passage and the third flow passage. Thereafter, the cooling air cools the casing wall, the outer diffuser, the strut, the strut cover, the inner diffuser and the partition wall, which are components of the exhaust chamber, before flowing out into a combustion gas in a diffuser part surrounded by the outer diffuser and the inner diffuser. Here, the flow rate of the cooling air taken in from the inflow hole is adjusted by the flow rate adjustment device. This allows the cooling air to flow at the same flow rate in the circumferential direction, even when dimensions of the first flow passage, the second flow passage and the third flow passage are non-uniform in the circumferential direction due to manufacturing dimensional tolerance of the components. As a result, the amount of thermal expansion of all the struts can be uniformized.

Further, the flow rate adjustment device may be an orifice member which is disposed in the second flow passage so as to protrude from an inner circumferential surface of the strut cover, and has an orifice installed between the strut cover and the strut.

By providing the orifice member having the orifice at the second flow passage, a flow passage area between all of the struts and strut covers in the circumferential direction can be made constant regardless of the manufacturing dimensional tolerance of the respective struts and strut covers. Thereby it is possible to adjust the cooling air flowing through the entire second flow passage to the same flow rate, and avoid non-uniformization of the cooling effect to the respective struts. Accordingly, eccentricity of a rotor caused by deviation in the amount of thermal expansion of the respective struts can be prevented. As a result, contact between a rotary body and stationary body can be prevented and performance of the gas turbine can be improved.

Further, the flow rate adjustment device may be an outflow hole which is installed at a downstream side in a flow direction of the cooling air of the third flow passage in an axial direction of the diffuser.

The cooling air having flowed through the respective second flow passages in the circumferential direction joins as one in the third flow passage, i.e., at the upstream of the outflow hole. Meanwhile, in an inlet of the diffuser part through which a combustion gas leaving a final stage blade is discharged, the pressure varies widely, and the pressure distribution in the circumferential direction is likely to occur. When the outflow hole is installed at the downstream side of the third flow passage in the flow direction of the cooling air in the axial direction of the diffuser, the outflow hole functions as a throttling section of a cooling air flow. Accordingly, pressure loss is applied to the cooling air flow, so that non-uniformity of the pressure distribution in the circumferential direction in the chamber forming the third flow passage can be reduced. The flow rate of the cooling air flowing through each of the second flow passages in the circumferential direction is determined by the pressure difference between the pressure in the third flow passage and the pressure outside the inflow hole. Therefore, by uniformizing pressure distribution in the circumferential direction, it is possible to reduce non-uniformaization of the flow rate of the cooling air flowing through the respective second flow passages in the circumferential direction, and prevent eccentricity of the rotor due to deviation in amount of thermal expansion of the respective struts.

In addition, the inflow hole may have a cover member capable of changing an opening area of the inflow hole.

Since access to the inflow hole from the outside is easy, adjustment of an intake amount of the cooling air from the outside can be performed by the cover member, and a total flow rate of the cooling air flowing into the exhaust chamber can be easily adjusted to an arbitrary flow rate. Accordingly, the cooling amount of the components can be easily adjusted.

In addition, the outflow hole may be disposed at an upstream side of the strut cover in a flow direction of a combustion gas in an axial direction of the diffuser.

At the upstream side in the flow direction of the combustion gas in the axial direction of the gas turbine, a negative pressure with respect to a static pressure is larger in comparison with the downstream side in the flow direction of the combustion gas in the axial direction of the diffuser. For this reason, when the cooling air is taken in by the pressure difference, a large amount of cooling air can be more smoothly taken in, and a higher cooling effect to the components can be obtained.

Effects of the Invention

According to the gas turbine of the present invention, the cooling air is uniformly discharged by the flow rate adjustment device into the diffuser part surrounded by the outer diffuser and the inner diffuser in the circumferential direction, so that an amount of thermal expansion of each strut can be uniformized, and eccentricity of the rotor can be prevented.

MODES FOR CARRYING OUT THE INVENTION

Hereinafter, a gas turbine 1 according to a first embodiment of the present invention will be described.

Figure 1:
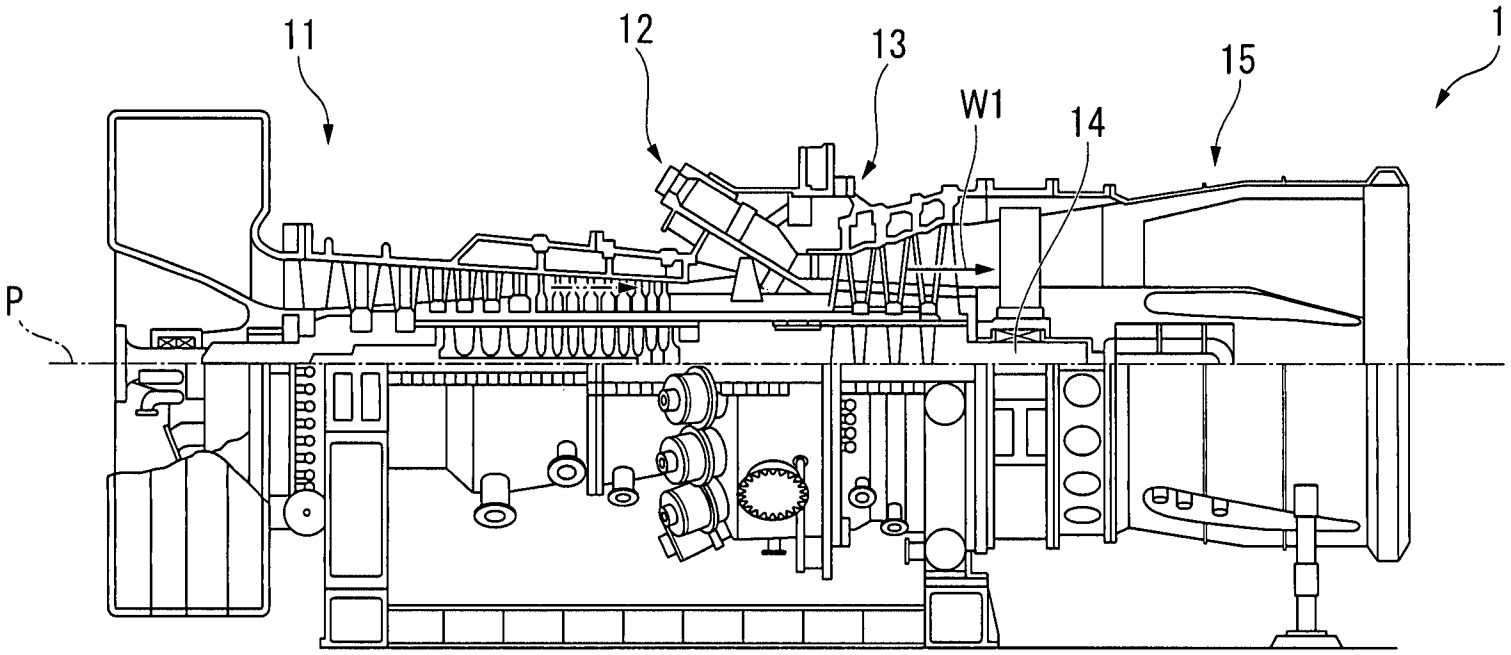
FIG. 1 is a schematic view of a gas turbine according to a first embodiment of the present invention.

As shown in FIG. 1, the gas turbine 1 is configured to generate a high temperature, high pressure combustion gas W1 by combusting compressed air produced in a compressor 11 after mixing with a fuel in a combustor 12. In addition, the turbine obtain rotational power by forcing the combustion gas W1 to flow into a turbine 13, and thereby causing a rotor 14 of the turbine 13 to rotate about an axis P. Further, the turbine 13 is connected to, for example, a generator (not shown) to generate power using the rotational power.

Then, the combustion gas W1 is exhausted through an exhaust chamber 15 after rotating the turbine 13.

Hereinafter, the compressor 11 side (a left side of FIG. 1) of the gas turbine 1 is referred to as an upstream side in the direction of the axis P, and the exhaust chamber 15 side (a right side of FIG. 1) is referred to as a downstream side in the direction of the axis P.

Figure 2:
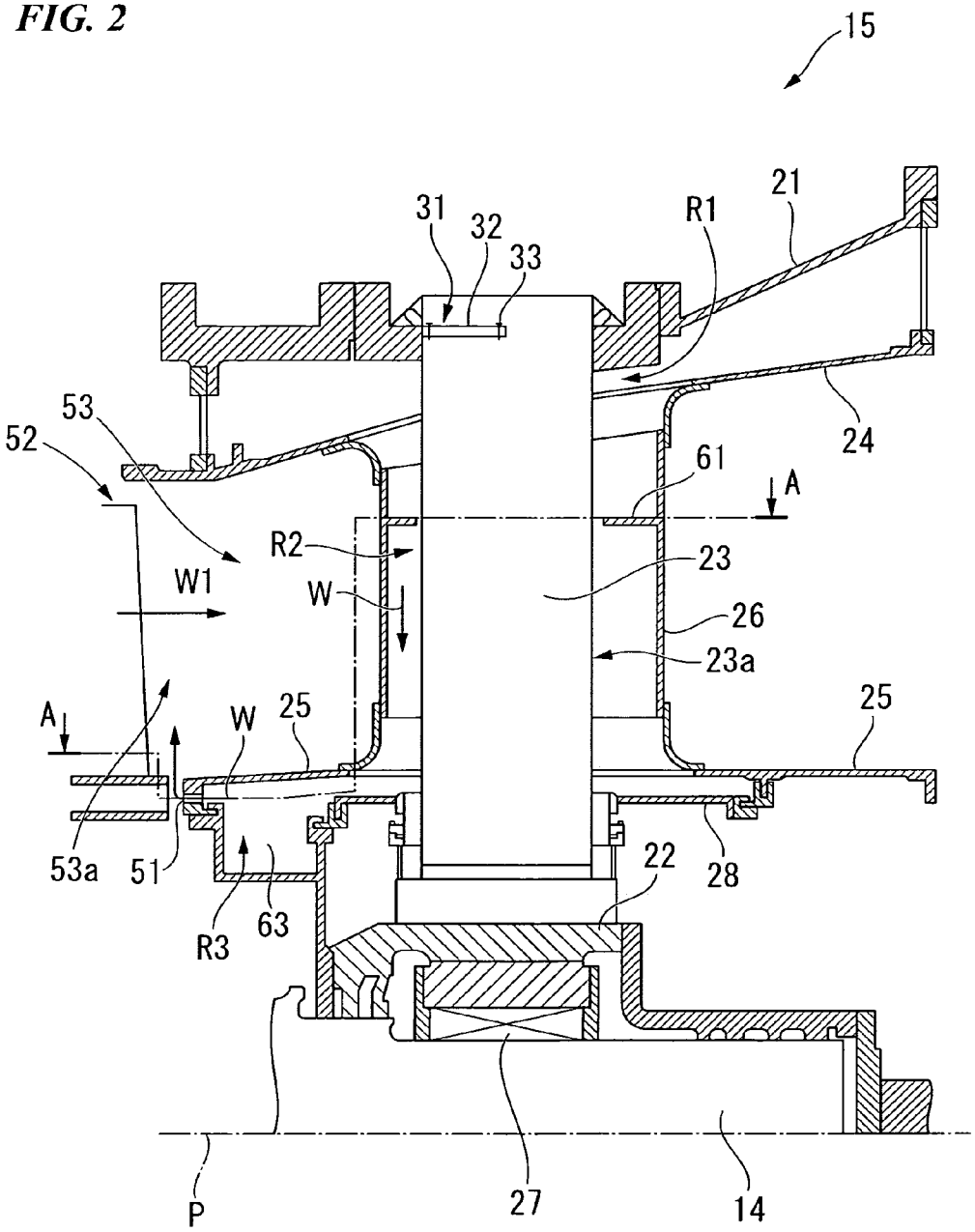
FIG. 2 is an enlarged view showing a strut installation portion of an exhaust chamber.
Figure 3:
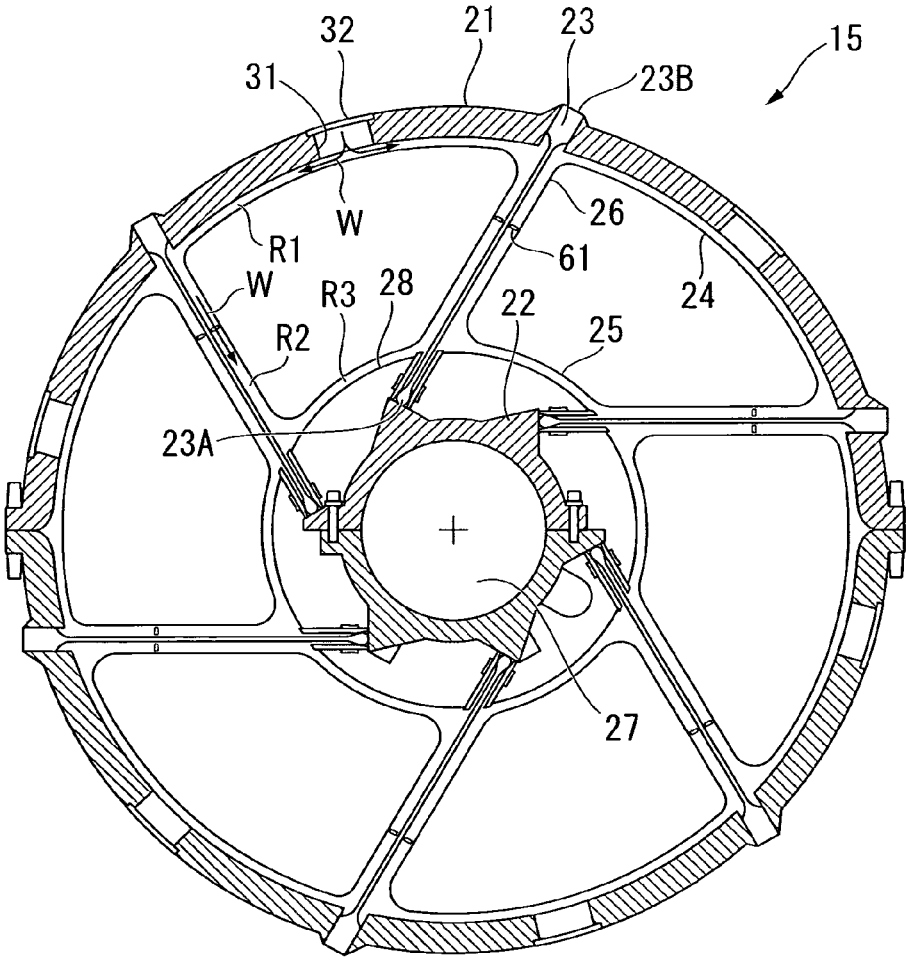
FIG. 3 is a view showing the strut installation portion of the exhaust chamber when seen in an axial direction thereof.

As shown in FIGS. 2 and 3, the exhaust chamber 15 includes a casing wall 21, a bearing case 22, and a strut 23. The bearing case 22 is disposed inside the casing wall 21 in a radial direction. The strut 23 connects the casing wall 21 to the bearing case 22.

Further, the exhaust chamber 15 includes an outer diffuser 24, an inner diffuser 25, a strut cover 26, and a partition wall 28. The outer diffuser 24 is installed along an inner circumferential surface of the casing wall 21. The inner diffuser 25 is installed along an outer circumferential surface of the bearing case 22. The strut cover 26 connects the outer diffuser 24 to the inner diffuser 25 and covers a strut outer circumference surface 23*a*. The partition wall 28 is installed between the inner diffuser 25 and the bearing case 22.

The casing wall 21 is a member having a cylindrical shape about the axis P and forming an outer shape of the exhaust chamber 15.

The bearing case 22 is a member disposed inside the casing wall 21 in a radial direction to accommodate and support a bearing 27 of the rotor 14 and having a cylindrical shape about the axis P.

In addition, the bearing case 22 has a protrusion. The protrusion is a portion protruding from the bearing case 22 and has a flat surface. The surface is a surface parallel to a plane along the axis P.

A first end 23A of the two ends of the strut 23 is coupled onto an outer circumferential surface of the bearing case 22, and a second end 23B of the strut 23 is coupled to the casing wall 21. That is, the strut 23 extends from the first end 23A outward in the radial direction to be directed to one side around the axis P, and is installed in plurality (in the embodiment, six) in a circumferential direction at predetermined intervals. Thereby, the bearing case 22 and the casing wall 21 are connected by the strut 23.

In addition, the first end 23A of the strut 23 is disposed perpendicular to the flat surface of the protrusion of the bearing case 22. The strut 23 is installed to extend in a tangential direction of the bearing case 22 having a cylindrical shape. While the bearing case 22 receives force in a rotational direction of the rotating rotor 14, the strut 23 supports the bearing case 22 in a direction opposite to the rotational direction. As a result, the bearing case 22 can be fixed without rotating the bearing case 22 around the axis P.

The outer diffuser 24 is a partition wall installed along the inner circumferential surface of the casing wall 21 inside in the radial direction of the casing wall 21, and is a member having a substantially cylindrical shape about the axis P. The strut 23 passes through the outer diffuser 24.

The inner diffuser 25 is a partition wall installed along the outer circumferential surface of the bearing case 22 inside the outer diffuser 24 and outside in the radial direction of the bearing case 22, and is a member having a substantially cylindrical shape about the axis P. The strut 23 passes through the inner diffuser 25.

The strut cover 26 is a partition wall connecting the outer diffuser 24 to the inner diffuser 25, and is a member covering around the strut 23 in an extension direction thereof.

The partition wall 28 is a partition wall installed between the inner diffuser 25 and the bearing case 22, and has a substantially cylindrical shape about the axis P. It prevents cooling air W having flowed through a second flow passage R2 from directly entering the rotor 14 via the bearing case 22 and the bearing 27.

Next, a flow passage through which the cooling air W flows will be described. The exhaust chamber 15 includes an inflow hole 31 of the cooling air W, and three flow passages including a first flow passage R1, the second flow passage R2 and a third flow passage R3 having an outflow hole 51. The exhaust chamber 15 further includes a diffuser part 53 which is surrounded by the outer diffuser 24 and the inner diffuser 25 and forms an annular space through which the combustion gas W1 leaving the turbine 13 flows.

The inflow hole 31 is an opening passing through the casing wall 21 through which the inside and the outside in the radial direction of the casing wall 21 communicate with each other and the cooling air W from the outside can flow in. The inflow hole 31 is installed in plurality (in the embodiment, six) in the circumferential direction at predetermined intervals, and each of the inflow holes 31 is disposed exactly in the middle of the neighboring struts 23 in the circumferential direction.

Figure 4:
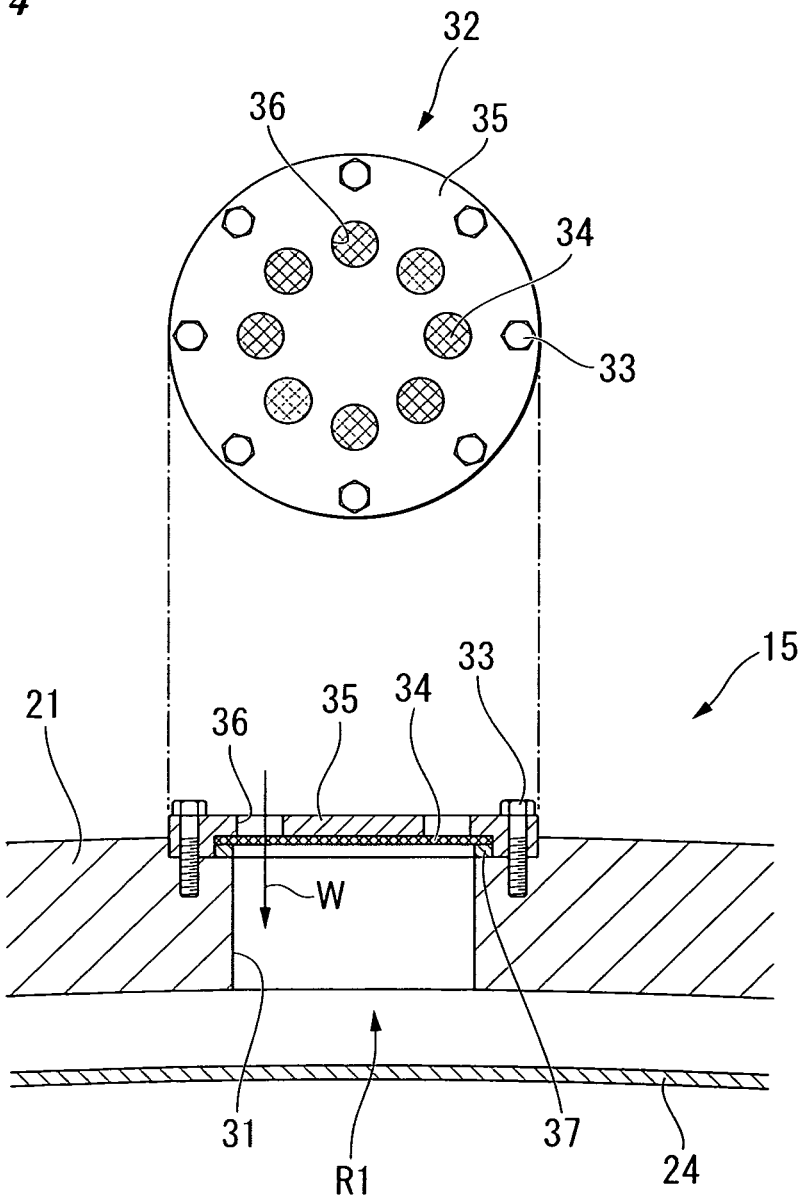
FIG. 4 is an enlarged view showing an inflow hole and a cover in a casing wall of the exhaust chamber.

Further, as shown in FIG. 4, a disc-shaped cover (a cover member) 32 is fixed to each of the inflow holes 31 by bolts 33. The cover 32 includes a net member 34, a cover main body 35, and a cover support member 37. The cover main body 35 covers the net member 34 from the further outside in the radial direction of the net member 34. The cover support member 37 supports the net member 34 from the inside in the radial direction. In the cover main body 35, a through hole 36 is installed in plurality (in the embodiment, eight) at predetermined intervals on a circumference having a constant radius from a center of the cover main body 35. That is, the inside and the outside of the casing wall 21 are in communication with each other through the through-holes 36, in a state in which the net member 34 is exposed to the outside only through the through-holes 36.

The first flow passage R1 is formed in a space between the casing wall 21 and the outer diffuser 24. The space and the inflow hole 31 are in communication with each other, so that the cooling air W introduced from the inflow hole 31 can flow through the first flow passage R1.

The second flow passage R2 is formed in a space between the strut cover 26 and the strut 23. The space and the first flow passage R1 are in communication with each other, so that the cooling air W introduced from the first flow passage R1 can flow through the second flow passage R2.

The third flow passage R3 is formed in a space between the inner diffuser 25 and the partition wall 28. The space and the second flow passage R2 are in communication with each other, so that the cooling air W introduced from the second flow passage R2 can flow through the third flow passage R3.

The diffuser part 53 is an annular space surrounded by the outer diffuser 24 and the inner diffuser 25 and into which the combustion gas W1 from a final stage blade part 52 is introduced from a diffuser inlet 53*a*.

Figure 5A:
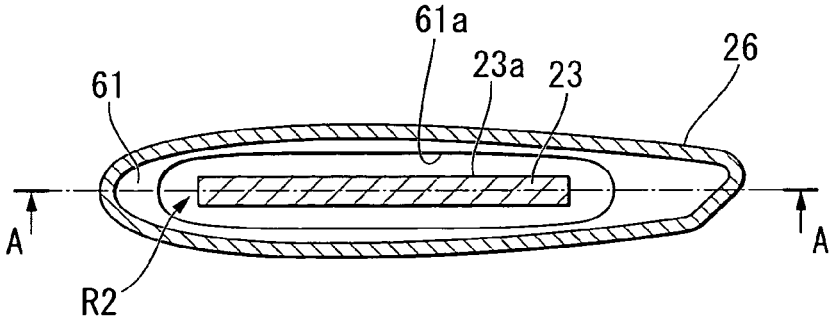
FIG. 5A is a view showing an orifice in a strut cover.
Figure 5B:
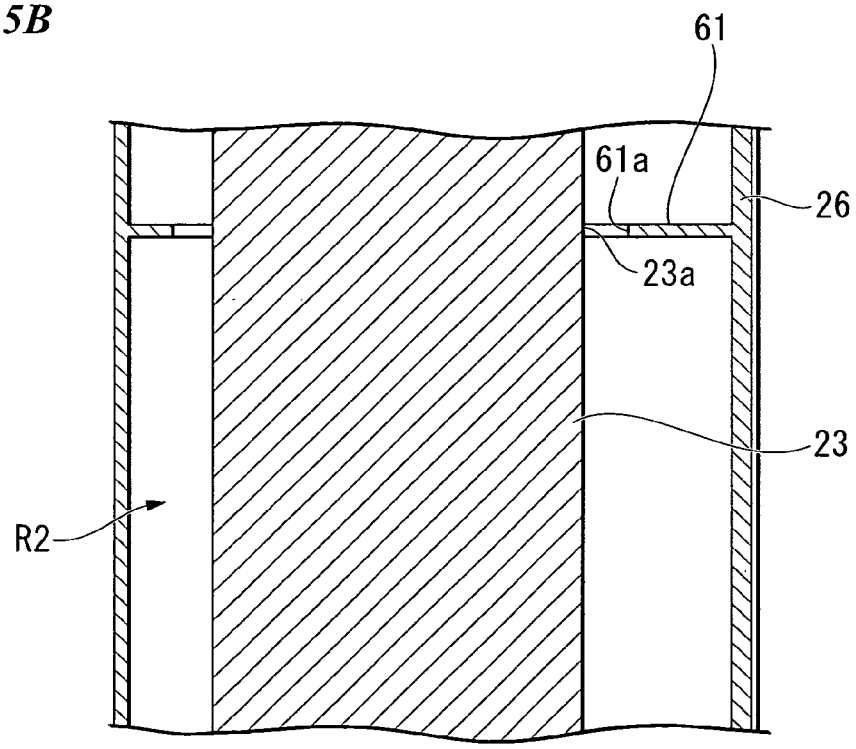
FIG. 5B is a cross-sectional view taken along line A-A of FIG. 5A, showing the orifice in the strut cover.
Figure 6:
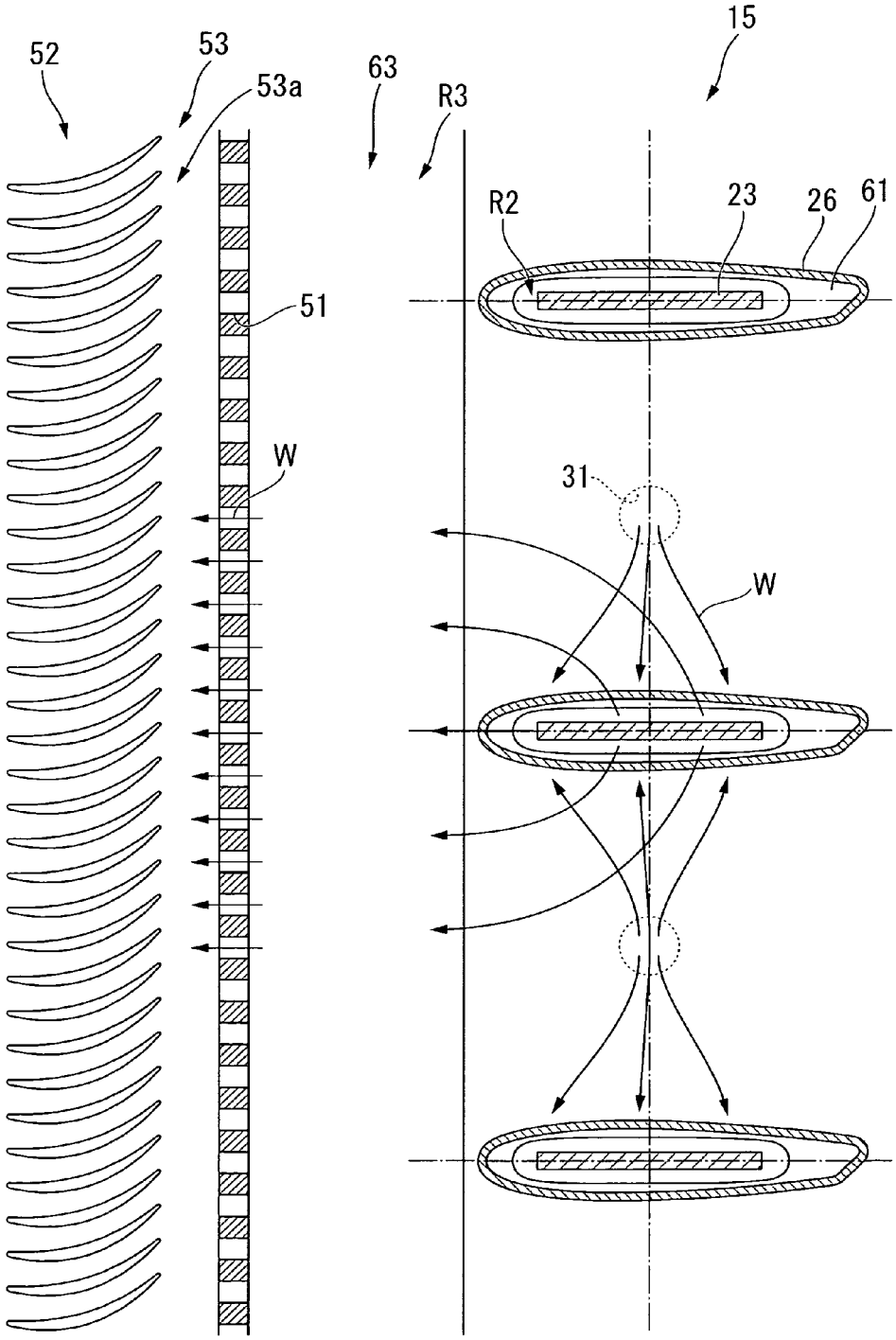
FIG. 6 is a cross-sectional view taken along line A-A of FIG. 2, schematically showing relation between the inflow hole and the orifice and between the chamber and an outflow hole.

Further, as shown in FIGS. 5A, 5B, and 6, the exhaust chamber 15 includes an orifice member (a flow rate adjustment device) 61, and a chamber 63. The orifice member (the flow rate adjustment device) 61 is installed in the second flow passage R2, i.e., between the strut cover 26 and the strut 23. The chamber 63 is installed in the third flow passage R3, i.e., between the inner diffuser 25 and the partition wall 28, and has the outflow hole (a flow rate adjustment device) 51 formed at a downstream side in a flow direction of the cooling air W.

The orifice member 61 is a member installed in the second flow passage R2 to protrude toward the inner circumferential surface of the strut cover 26 and having a flow passage area between the orifice member 61 and the strut 23. An orifice 61*a* and a strut outer circumference surface 23*a* are machined so as to improve tolerance. Then, the orifice member 61 having the same flow passage area is installed in the entire strut cover 26 such that a flow rate of the cooling air W flowing through the entire second flow passage R2 is uniformized. The orifice member 61 is a baffle member installed in the second flow passage R2 to reduce a cross-sectional area of the second flow passage R2.

The chamber 63 is an annular space which forms the third flow passage R3 and is surrounded by the inner diffuser 25 and the partition wall 28 to communicate in the circumferential direction. The outflow hole 51 is disposed at a downstream side of the flow direction of the cooling air W in the direction of the axis P in the chamber 63.

The outflow holes 51 are openings formed in a flow direction of the combustion gas W1 in the direction of the axis P of the inner diffuser 25 and disposed in the diffuser inlet 53*a* at the upstream side at predetermined intervals in the circumferential direction. The outflow holes 51 allows communication between the inside of the inner diffuser 25 and the outside so that the cooling air W having passed through the third flow passage R3 can flow into the diffuser part 53 immediately downstream of an outlet of the final stage blade part 52 in the turbine 13.

In the above-mentioned gas turbine 1, the outside air is taken as the cooling air W from the inflow hole 31 of the casing wall 21 to flow into the first flow passage R1. Here, a pressure (static pressure) of the diffuser inlet 53*a* through which the combustion gas W1 leaving the final stage blade part 52 of the turbine 13 is discharged is in a negative pressure state. The cooling air W is automatically suctioned from the inflow hole 31 and taken into the diffuser part 53 due to its negative pressure. Then, the casing wall 21 and the outer diffuser 24 are cooled by the cooling air W while it flows through the first flow passage R1.

Thereafter, in the cooling air W having flowed into each of the second flow passages R2 in the circumferential direction, a constant pressure difference is secured in the cooling air W between the upstream side and the downstream side of the orifice member 61 in the entire second flow passage R2 by the orifice member 61 installed in the strut cover 26, so that a flow rate of the cooling air W is adjusted. Accordingly, non-uniformization of the flow rate of the cooling air W flowing through the respective second flow passages R2 in the circumferential direction can be suppressed.

Then, a flow rate of the cooling air W flowing through the respective second flow passages R2 in the circumferential direction is adjusted by the orifice member 61, and the cooling air W cools the strut cover 26 and the strut 23 before flowing into the third flow passage R3.

In the third flow passage R3, the inner diffuser 25 and the partition wall 28 are cooled by the cooling air.

Here, the flow rate of the cooling air W flowing through the respective second flow passages R2 in the circumferential direction is determined by a pressure difference between the pressure in the third flow passage R3 and the pressure in the first flow passage R1. Meanwhile, the cooling air W in the third flow passage R3 is blown to the diffuser inlet 53*a* of the diffuser part 53 in which the combustion gas W1 flows downward. The diffuser inlet 53*a* is disposed at a position at which the combustion gas W1 leaving the final stage blade part 52 flows out and the pressure distribution in the circumferential direction is non-uniform.

In addition, for normal function of the orifice member 61 installed in the second flow passage R2, it is necessary to stabilize the pressure difference of the cooling air W between the upstream side and the downstream side of the orifice member 61, and stabilize a pressure (static pressure) in the third flow passage R3.

In the diffuser inlet 53*a* through which the cooling air W blows out, as described above, the pressure distribution in the circumferential direction is non-uniform, and the pressure varies widely. For this reason, the outflow hole 51 which functions as a throttling section is annularly installed at a downstream side of the third flow passage R3 in the flow direction of the cooling air W in the direction of the axis P. By applying pressure loss sufficient for absorbing the pressure variation in the circumferential direction of the diffuser inlet 53*a* to the cooling air W blowing out from the outflow hole 51, the pressure in the circumferential direction of the third flow passage R3 can be stabilized without being affected by the pressure variation in the diffuser part 53.

As the pressure in the circumferential direction of the third flow passage R3 is stabilized, a pressure difference of the cooling air W between the upstream side and the downstream side flowing through the orifice member 61 is stabilized. Accordingly, it is possible to reduce non-uniformization of the flow rate of the cooling air W flowing through the respective second flow passages R2 in the circumferential direction, and thereby reduce deviation in the amount of thermal expansion of the respective struts 23 can be reduced.

It is preferable that the chamber 63 has a sufficient capacity in comparison with a total amount of the cooling air W flowing from the inflow hole 31 and flowing around the strut 23. When the capacity of the chamber 63 is larger in comparison with the flow rate of the cooling air W, a constant pressure can be maintained in the chamber 63 even when the flow rate of the cooling air W is varied.

While the cooling air W flows into the inflow hole 31 via the through-hole 36 installed in the cover main body 35, introduction of contaminants, dust, dirt, and so on can be prevented by the net member 34.

Further, at the stage of a test operation of the gas turbine, a total flow rate of the cooling air W flowing around the strut 23 may be adjusted as a tuning operation. In this case, a flow passage area of the cooling air W supplied from the inflow hole 31 is adjusted. That is, the hole diameter of the through-hole 36 installed in the cover main body 35 can be easily varied by replacing the cover main body 35 with another cover main body 35 having a different hole diameter. By this method, the total flow rate of the cooling air W flowing into the exhaust chamber 15 from the inflow hole 31 can be adjusted to an arbitrary value.

In addition, since the combustion gas W1 that has completed its task in the turbine 13 recovers the pressure (a static pressure) as it flows to the downstream side in the direction of the axis P in the diffuser part 53, a negative pressure value with respect to the static pressure is larger at the upstream side in the direction of the axis P. In the embodiment, since the outflow hole 51 is installed at the upstream side in the direction of the axis P of the inner diffuser 25, a larger amount of the cooling air W can be smoothly taken in from the inflow hole 31 to improve a cooling effect of the components in the exhaust chamber 15.

Here, the strut 23 is connected to protrude from the bearing case 22 in a tangential direction thereof. When the strut 23 is expanded and contracted by heat, if the expansion and contraction amount by heat of the respective struts 23 is uniform, the bearing case 22 is rotated about the axis P, and eccentricity of the rotor 14 can be avoided.

According to the gas turbine 1 of the embodiment, the cooling air W taken in from the inflow hole 31 can constantly maintain the flow passage area of each of the second flow passages R2 by means of the orifice member 61 installed at the second flow passage R2. In addition, the pressure distribution in the circumferential direction can be uniformized by the chamber 63 installed upstream of the outflow hole 51. As a result, the flow rate of the cooling air W flowing through the second flow passages R2 separated in the circumferential direction can be maintained at the same flow rate in the entire second flow passage R2, and non-uniformization of the cooling effect of the components in the circumferential direction can be solved. Accordingly, the expansion and contraction amount by heat of the respective struts 23 in the circumferential direction can be uniformized, and eccentricity of the rotor 14 can be suppressed by causing the bearing case 22 to rotate about the axis P.

In addition, since the opening area of the inflow hole 31 of the cover main body 35 can be easily varied, the total flow rate of the cooling air W flowing into the exhaust chamber 15 can be easily adjusted to an arbitrary flow rate. Accordingly, adjustment of the cooling amount of the components can be easily performed.

Further, as the outflow hole 51 is installed in the diffuser inlet 53*a* at the upstream side in the direction of the axis P of the diffuser part 53, the cooling air W can be smoothly introduced and the flow rate can be increased. Accordingly, the cooling effect to the components in the exhaust chamber 15 can be improved, leading to improved performance of the gas turbine 1.

In addition, when the cooling air W flows from the first flow passage R1 to pass through the third flow passage R3, the cooling air W is heated by heat exchange between the components and the cooling air W, and non-uniform pressure distribution may occur in the circumferential direction in the chamber 63 due to a generated stack effect. However, as the appropriate pressure loss (the pressure loss sufficient for the stack effect) is applied by the above-mentioned orifice member 61, the influence by the stack effect can be reduced to a negligible level, and the flow rate of the cooling air W can be uniformized.

Hereinabove, while the embodiment of the present invention has been described in detail, some design changes may be made without departing from the technical spirit of the present invention.

For example, when the inner circumferential surface of the strut cover 26 can be machined to maintain a constant flow rate of the cooling air W flowing through the respective second flow passages R2 in the circumferential direction, there is no need to provide the orifice member 61 at the second flow passage R2.

In addition, when the pressure distribution in the circumferential direction in the third flow passage R3 upstream of the outflow hole 51 is constant, the outflow hole 51 may be omitted.

Further, in the embodiment, while the strut 23 is installed to protrude in the tangential direction of the bearing case 22, for example, the strut 23 may be installed to protrude outward in the radial direction, and the number of struts 23 is not limited to six.

Furthermore, while the cooling air W from the inflow hole 31 is taken in by the negative pressure, the cooling air W may be taken in by forcing in from the inflow hole 31 using a fan or the like.

Then, while the outflow hole 51 is disposed at the diffuser inlet 53*a* at the upstream side in the direction of the axis P of the diffuser part 53, it may be disposed at the downstream side in the direction of the axis P. In this case, since the negative pressure amount is smaller in comparison with the upstream side in the direction of the axis P, an intake amount of the cooling air W is reduced. However, the flow rate can be adjusted by increasing the hole diameter of the inflow hole 31.

DESCRIPTION OF REFERENCE NUMERALS

1 . . . gas turbine
11 . . . compressor
12 . . . combustor
13 . . . turbine
14 . . . rotor
15 . . . exhaust chamber
21 . . . casing wall
22 . . . bearing case
23 . . . strut
23*a* . . . strut outer circumference surface
23A . . . first end
23B . . . second end
24 . . . outer diffuser
25 . . . inner diffuser
26 . . . strut cover
27 . . . bearing
28 . . . partition wall
31 . . . inflow hole
32 . . . cover (cover member)
33 . . . bolt
34 . . . net member
35 . . . cover main body
36 . . . through-hole
37 . . . cover support member
51 . . . outflow hole
52 . . . final stage blade part
53 . . . diffuser part
53*a* . . . diffuser inlet
61 . . . orifice member
61*a* . . . orifice
63 . . . chamber
W . . . cooling air
W1 . . . combustion gas
P . . . axis
R1 . . . first flow passage
R2 . . . second flow passage
R3 . . . third flow passage

What is claimed is:

1. A gas turbine comprising:

a casing wall having a cylindrical shape centered at an axis and forming an outer shape of an exhaust chamber;

a bearing case disposed inside the casing wall in a radial direction and supporting a bearing of a rotor;

a plurality of struts installed on an outer circumferential surface of the bearing case at predetermined intervals in a circumferential direction of the bearing case and connecting the casing wall to the bearing case;

an outer diffuser installed along an inner circumferential surface of the casing wall;

an inner diffuser installed along the outer circumferential surface of the bearing case;

a strut cover connecting the outer diffuser to the inner diffuser and covering the strut from an outer circumference side of the strut; and a partition wall installed between the inner diffuser and the bearing case and covering the bearing case from an outer circumference side of the bearing case, wherein the gas turbine comprises:

an inflow hole installed in the casing wall and taking cooling air into the casing wall from the outside, the inflow hole having a cover member which has a plurality of through holes capable of adjusting a flow passage area of the cooling air supplied according to opening areas of the through holes;

a first flow passage formed between the casing wall and the outer diffuser and communicated with the inflow hole to allow the cooling air to flow therethrough;

a second flow passage communicated with the first flow passage to allow the cooling air to flow therethrough, the second flow passage having a first flow rate adjustment device which is formed between the strut and the strut cover and which is installed so as to protrude from an inner circumferential surface of the strut cover, to be fixed to whole circumference of the strut cover, and to have a space between the strut and the first flow rate adjustment device; and a third flow passage communicated with the second flow passage at an upstream side in the flow direction of the cooling air, the third flow passage having an outflow hole which is formed between the inner diffuser and the partition wall and which is an opening portion installed at an inlet of the diffuser at a downstream side in a flow direction of the cooling air, wherein the plurality of through holes is arranged at predetermined intervals on a circumference having a constant radius from a center of the cover member.

2. The gas turbine according to claim 1, wherein the first flow rate adjustment device is an orifice member formed along the whole inner circumferential surface of the strut cover.

3. The gas turbine according to claim 1, wherein the outflow hole is disposed at an upstream side relative to the strut cover in a flow direction of a combustion gas in an axial direction of the outer diffuser and the inner diffuser.

4. The gas turbine according to claim 2, wherein the outflow hole is disposed at an upstream side relative to the strut cover in a flow direction of a combustion gas in an axial direction of the outer diffuser and the inner diffuser.

* * * * *